US011829108B2

(12) United States Patent
Nagasaka

(10) Patent No.: US 11,829,108 B2
(45) Date of Patent: Nov. 28, 2023

(54) TIMEPIECE PART AND TIMEPIECE

(71) Applicant: Seiko Epson Corporation, Tokyo (JP)

(72) Inventor: Eiichi Nagasaka, Minowa (JP)

(73) Assignee: SEIKO EPSON CORPORATION

( * ) Notice: Subject to any disclaimer, the term of this patent is extended or adjusted under 35 U.S.C. 154(b) by 0 days.

(21) Appl. No.: 17/837,095

(22) Filed: Jun. 10, 2022

(65) Prior Publication Data

US 2022/0299941 A1 Sep. 22, 2022

Related U.S. Application Data

(63) Continuation of application No. 16/661,242, filed on Oct. 23, 2019, now Pat. No. 11,409,244.

(30) Foreign Application Priority Data

Oct. 24, 2018 (JP) ..... 2018-199766

(51) Int. Cl.
*G04B 13/02* (2006.01)
*G04B 15/14* (2006.01)

(52) U.S. Cl.
CPC ..... *G04B 15/14* (2013.01); *G04B 13/02* (2013.01)

(58) Field of Classification Search
CPC . F16D 7/00; F16D 1/0805; F16D 1/05; F16D 41/12; G04B 35/00; G04B 33/08; G04B 19/02
See application file for complete search history.

(56) References Cited

U.S. PATENT DOCUMENTS 165,275 A 7/1875 Thompson
3,318,088 A 5/1967 JeanMonod
3,593,542 A * 7/1971 Urayama ..... F16D 43/2028 464/37
3,785,141 A 1/1974 Ikegami
3,855,787 A * 12/1974 Assmus ..... G04B 19/044 968/144
3,979,901 A 9/1976 Nakagawa
6,508,140 B2 * 1/2003 Zaps ..... F16H 55/14 74/411

(Continued)

FOREIGN PATENT DOCUMENTS

EP 1705533 * 4/2010

OTHER PUBLICATIONS

Strip—https://www.merriam-webster.com/dictionary/strip—Apr. 1, 2023.*

*Primary Examiner* — Sean Kayes
(74) *Attorney, Agent, or Firm* — Harness, Dickey & Pierce, P.L.C.

(57) ABSTRACT

Provided is a timepiece part that reduces axial runout of a flat member when the rotating axle thereof turns. A escape wheel and pinion 18 includes an axle member having a first shaft 44 and a second shaft 45 that is larger in diameter than the first shaft, and a seat 48 disposed outside the position where the first shaft and the second shaft connect; a guide member 49 disposed in contact with the seat, having a first hole in which the first shaft is inserted, and having a diameter greater than the second shaft; an escape wheel 23 disposed in contact with the guide member and having a second hole in which the first shaft is inserted; and a fixing member 50 disposed in contact with the escape wheel, having a third hole in which the first shaft is inserted.

11 Claims, 9 Drawing Sheets

(56) References Cited

U.S. PATENT DOCUMENTS

| | | | | |
|---|---|---|---|---|
| 6,687,192 | B2 | 2/2004 | Bettelini et al. | |
| 7,651,259 | B2 | 1/2010 | Carrard et al. | |
| 8,210,740 | B2 * | 7/2012 | Verardo | G04B 13/022 368/323 |
| 8,277,117 | B2 * | 10/2012 | Verardo | G04B 13/021 368/320 |
| 9,323,221 | B2 * | 4/2016 | Villar | B29C 45/1459 |
| 2018/0046142 | A1 * | 2/2018 | Fukuda | G04B 13/026 |
| 2018/0314208 | A1 | 11/2018 | Shibuya et al. | |
| 2018/0335754 | A1 | 11/2018 | Shibuya et al. | |
| 2018/0356768 | A1 | 12/2018 | Shibuya et al. | |

* cited by examiner

TIMEPIECE PART AND TIMEPIECE

This application is a continuation of U.S. patent application Ser. No. 16/661,242 filed Oct. 23, 2019, which claims priority from Japan Patent Application No. 2018-199766, filed on Oct. 24, 2018, all of which are hereby expressly incorporated by reference herein in their entireties.

BACKGROUND

1. Technical Field

The present invention relates to a timepiece part and to a timepiece.

2. Related Art

EP1705533(A1) describes a mechanical part having a metal axle member inserted to a rotating member made of silicon, and fixed by a metal fixing member. The axle member has a shaft member protruding along the axis from a pinion. A hole is formed in the center of the rotating member. The shape of the fixing member is also disk-like with a hole in the center. The shaft member is inserted through the hole in the rotating member. The shaft member is also inserted in the hole in the fixing member.

A pinion, rotating member, and fixing member are disposed in this order in the axial direction of the shaft member. The fixing member is fit and fixed to the shaft member. The rotating member is held between the pinion and the fixing member.

In EP1705533(A1) the pinion and the rotating member are disposed in contact with each other. The rotating member can turn sliding against the shaft member as the axle. The surface of contact between the pinion and rotating member is a first surface, and the surface of contact between the fixing member and the rotating member is a second surface. In this configuration, relative to the axis of the axle member, the angle of the plane of the rotating member to the axis of the rotating member is defined by the first surface and the second surface.

When both the first surface and second surface contact at a position separated from the axis of the rotating member, the plane direction of the rotating member to the axis of the axle member can approach a right angle. For example, when the pinion is formed on the axle member by a turning process, the maximum diameter of the axle member is limited to the outside diameter of the teeth of the pinion. In this case, the size of the first surface is determined by the size of the outside diameter of the teeth of the pinion. As a result, when the outside diameter of the pinion teeth is small, the plane direction of the rotating member to the axis of the axle member cannot approach a right angle. In this event, when the axle member turns, runout of the flat member, that is, the rotating member, to the axial direction increases.

A timepiece part that can decrease runout of the flat member to the axial direction when the axle member turns regardless of the shape of the axle member is therefore needed.

SUMMARY

A timepiece part according to one aspect of the invention has a rotating axle including a first shaft, a second shaft disposed coaxially to the first shaft, connected to the first shaft, and having a diameter greater than the first shaft, and a seat disposed to the position where the first shaft and the second shaft connect; a guide member disposed in contact with the seat, having a first opening in which the first shaft is inserted, and a diameter greater than the second shaft; a flat member disposed in contact with the guide member, and having a second opening in which the first shaft is inserted; and a fixing member disposed in contact with the flat member, having a third opening in which the first shaft is inserted, and a diameter greater than the second shaft.

In a timepiece part according to another aspect of the invention, the guide member of the timepiece part is made from an iron alloy or a titanium alloy, the flat member contains silicon, and the fixing member is made from copper, a copper alloy, aluminum, or an aluminum alloy.

In a timepiece part according to another aspect of the invention, the fixing member has, in the surface that contacts the flat member, a recess where the fixing member does not contact the flat member.

Further preferably in a timepiece part according to another aspect of the invention, the first shaft has a groove formed in the axial direction; the flat member has a support part that overlaps the guide member and the fixing member in a plan view from the axial direction, and a rim with multiple teeth; and the support part includes multiple first ribs disposed between the rim and the rotating axle, and a second rib disposed between the multiple first ribs. The ends of the first ribs are disposed in the groove, and the end of the second rib pushes against the rotating axle.

Further preferably in a timepiece part according to another aspect of the invention, the second ribs branch from the first ribs, and a spring member is disposed between the ends of the second ribs and the junction with the first ribs.

In a timepiece part according to another aspect of the invention, the timepiece part is an escape wheel, pallet, barrel complete, or gear.

Another aspect of the invention is a timepiece comprising the timepiece part of the invention.

Other objects and attainments together with a fuller understanding of the invention will become apparent and appreciated by referring to the following description and claims taken in conjunction with the accompanying drawings.

DESCRIPTION OF EMBODIMENTS

Figure 1:
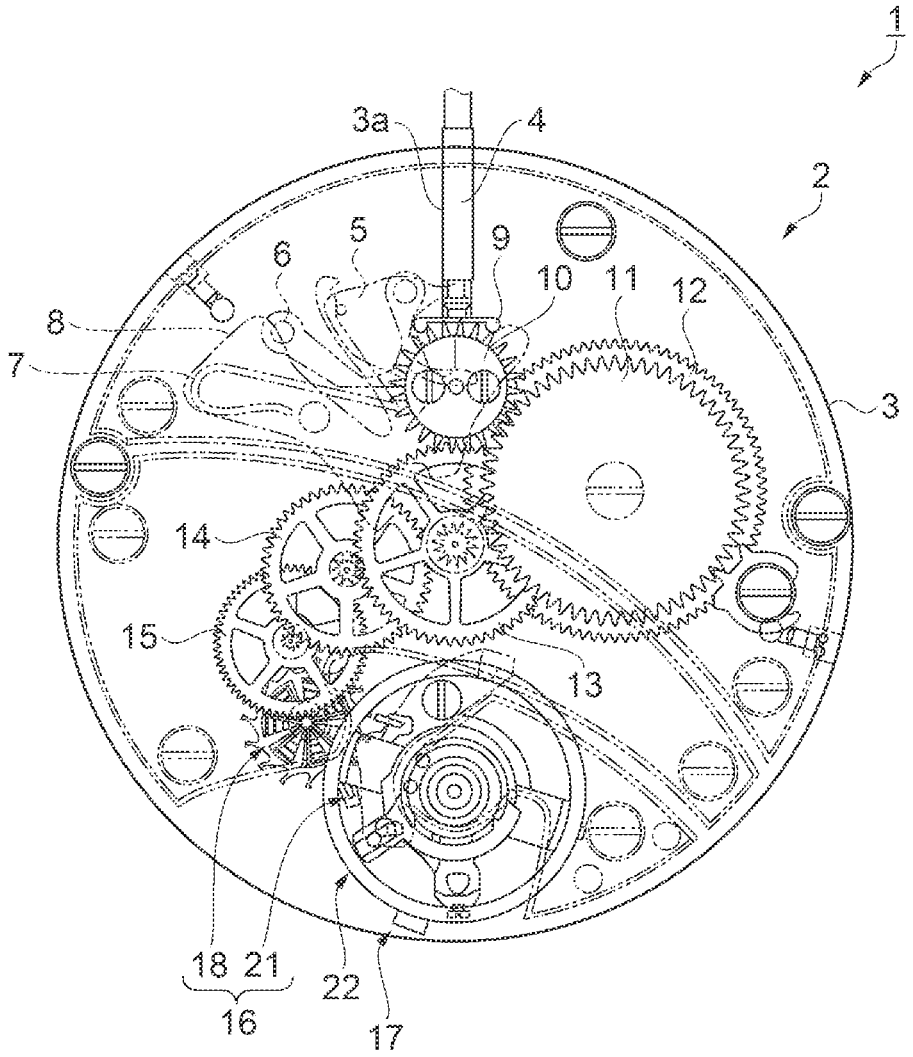
FIG. 1 is a schematic plan view illustrating the structure of a movement for a mechanical timepiece according to a preferred embodiment of the invention.

A preferred embodiment of the invention is described next with reference to the accompanying figures. Note that the members shown in the figures are sized to enable easy recognition in the drawings, and all parts are not necessarily drawn at the same scale.

Embodiments

Preferred embodiments of a mechanical timepiece and an escape wheel, which is one gear configuring a timepiece part in the movement of a mechanical timepiece, are described below with reference to the accompanying figures. A mechanical timepiece and an escape wheel according to embodiments of the invention are described with reference to FIG. 1 to FIG. 8.

Mechanical Timepiece

A mechanical timepiece 1 as a timepiece according to a preferred embodiment of the invention is described first. FIG. 1 is a schematic plan view illustrating the structure of the movement of a mechanical timepiece according to this embodiment. FIG. 1 shows the front side of the movement. As shown in FIG. 1, the mechanical timepiece 1 includes a movement 2, and a case member not shown in which the movement 2 is held.

The side of the movement 2 as seen in FIG. 1 is referred to as the front, and the side as seen from the opposite side of the page is referred to as the back.

The movement 2 has a main plate 3. A dial not shown is disposed on the back side of the main plate 3.

The wheel train assembled on the front side of the movement 2 is referred to as the front wheel train, and the wheel train assembled on the back side of the movement 2 is referred to as the back wheel train.

A winding stem guide hole 3*a* is formed in the side of the main plate 3. The winding stem guide hole 3*a* is formed from the top side down in the view in FIG. 1. A winding stem 4 is passes freely rotatably through the winding stem guide hole 3*a*. The location of the axial direction of the winding stem 4 is determined by the setting mechanism configured by the setting lever 5, yoke 6, yoke spring 7, and setting lever jumper 8, for example. A winding pinion 9 is disposed freely rotatably to the winding stem 4.

The user can change the position of the winding stem 4 by moving the winding stem 4 in the axial direction. The position of the winding stem 4 when the user pushes the winding stem 4 into the movement 2 is referred to as a first stem position. The first stem position is where the winding stem 4 is closest to the inside of the movement 2.

The user can turn the winding stem 4 when the winding stem 4 is at the first stem position. This causes the winding pinion 9 to turn through rotation of a sliding pinion not shown.

A crown wheel 10, ratchet wheel 11 and barrel wheel 12 are rotatably disposed to the main plate 3. When the winding pinion 9 turns, the crown wheel 10 meshed with the winding pinion 9 turns. When the crown wheel 10 turns, the ratchet wheel 11 meshed with the crown wheel 10 turns. When the ratchet wheel 11 turns, the mainspring not shown housed in the barrel wheel 12 is wound. The mainspring is the power source that drives the movement 2.

A center wheel 13, third wheel 14, and fourth wheel 15 are rotatably disposed to the main plate 3. The center wheel 13, third wheel 14, and fourth wheel 15 are also referred to as a wheel and pinion. The front wheel train of the movement 2 is configured by the barrel wheel 12, center wheel 13, third wheel 14, and fourth wheel 15. The front wheel train functions to transfer torque from the barrel wheel 12.

An escapement 16 and regulator 17 are also disposed to the main plate 3 on the front side of the movement 2. The escapement 16 and regulator 17 control rotation of the front wheel train.

The center wheel 13 is a wheel that meshes with the barrel wheel 12. The third wheel 14 is a wheel that meshes with the center wheel 13. The fourth wheel 15 is a wheel that meshes with the third wheel 14.

The escapement 16 is a mechanism that controls rotation of the front wheel train. The escapement 16 includes an escape wheel and pinion 18 and pallet 21 as timepiece parts. The mechanical timepiece 1 therefore includes an escape wheel and pinion 18.

The escape wheel and pinion 18 meshes with the fourth wheel 15, receives torque from the fourth wheel 15, and turns. The pallet 21 escapes the escape wheel and pinion 18 and causes the escape wheel and pinion 18 to turn at a constant speed. The regulator 17 is a mechanism for adjusting operation of the escapement 16. The regulator 17 includes a balance 22, which swings at a constant rate.

Escape Wheel and Pinion

The escape wheel and pinion 18 is described in detail next.

Figure 2:
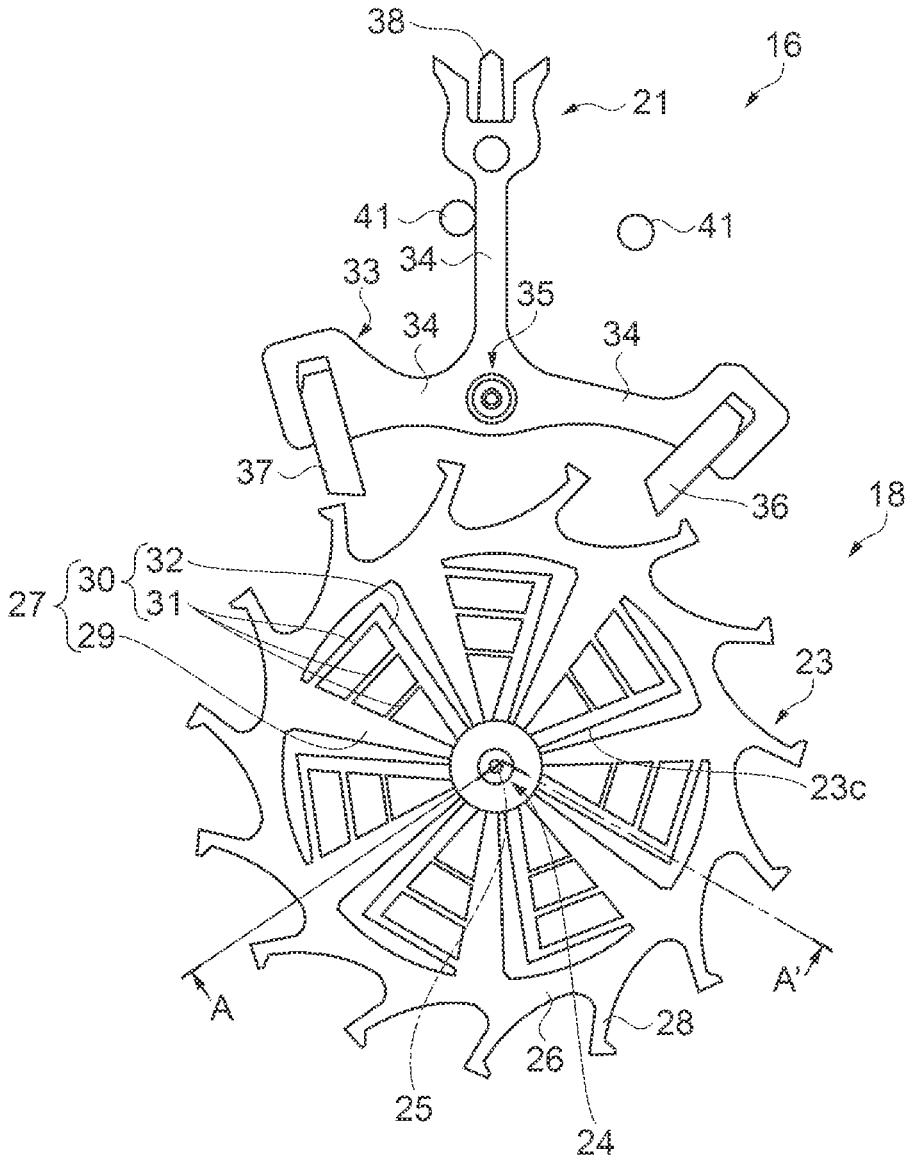
FIG. 2 is a schematic plan view showing the structure of the escapement.
Figure 3:
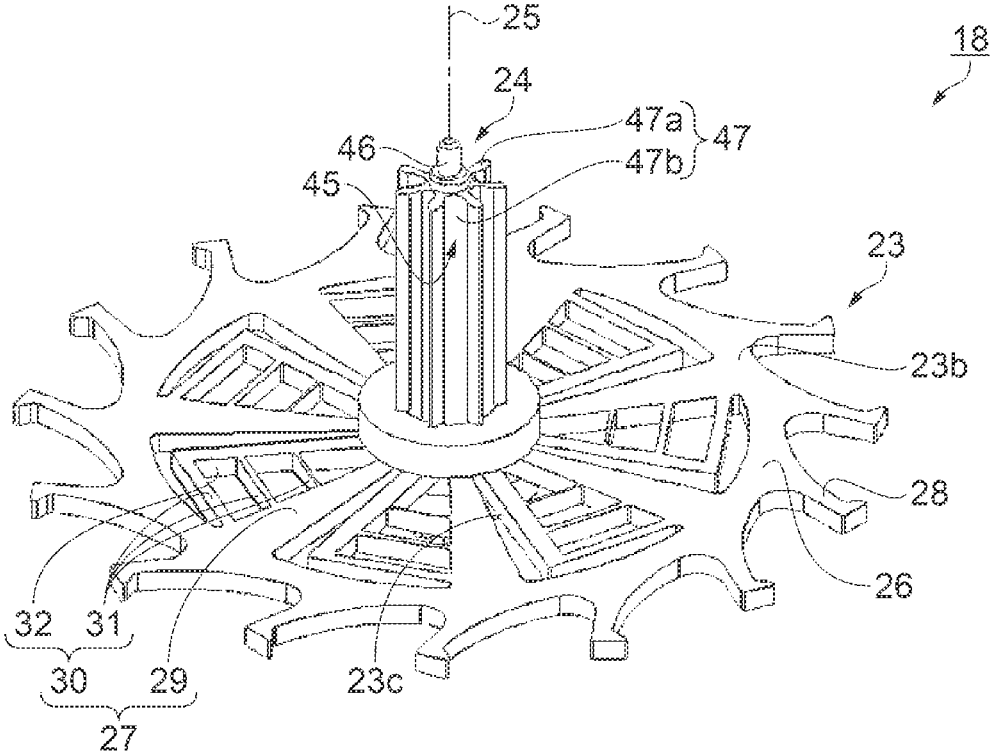
FIG. 3 is a perspective view of the structure of the escape wheel.
Figure 4:
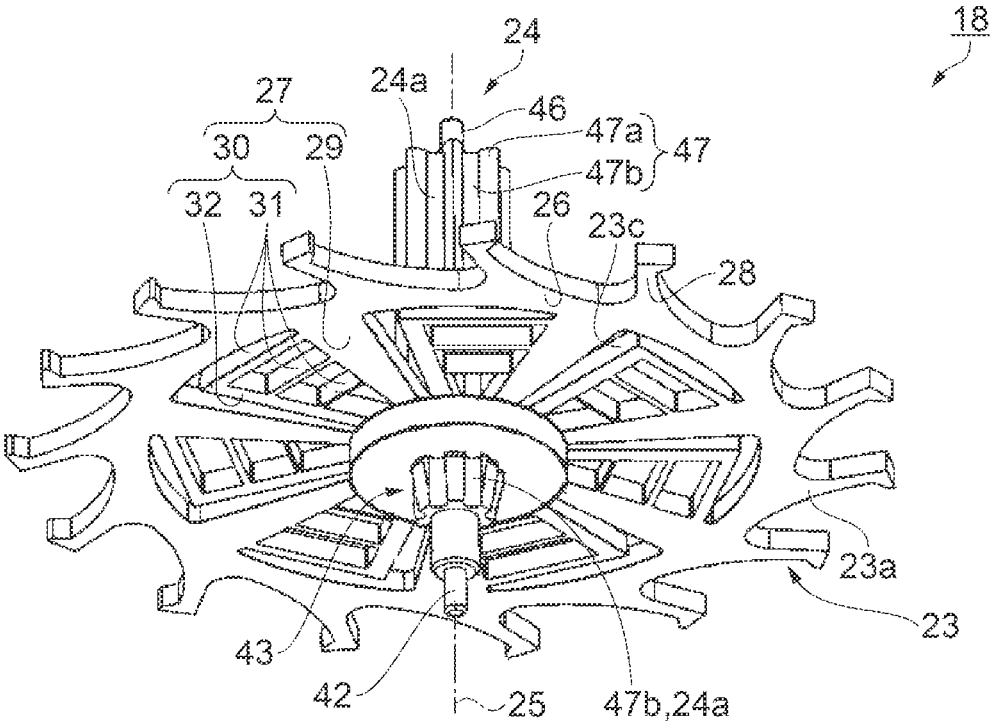
FIG. 4 is a perspective view of the structure of the escape wheel.
Figure 5:
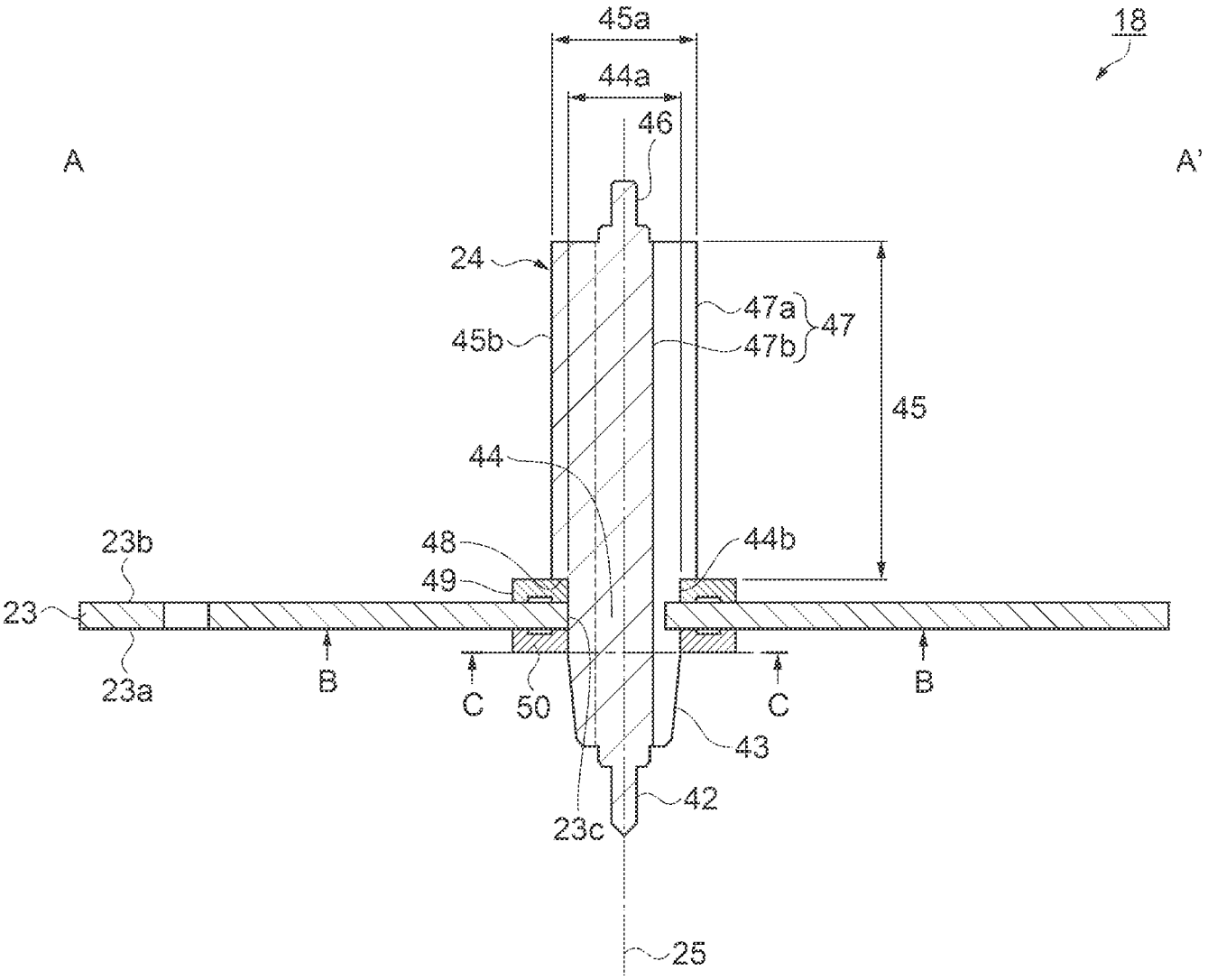
FIG. 5 is a schematic side section view of the structure of the escape wheel.

FIG. 2 is a schematic plan view showing the structure of the escapement. FIG. 3 and FIG. 4 are perspective views showing the structure of the escape wheel and pinion 18. FIG. 3 and FIG. 4 show the escape wheel and pinion 18 from different directions. FIG. 5 is a side section view showing the structure of the escape wheel and pinion 18, and is a section view through line A-A' in FIG. 2.

As shown in FIG. 2 to FIG. 5, the escape wheel and pinion 18 is configured by an escape wheel 23 as a flat member, and an axle member 24 as a pinion. The mechanical timepiece 1 therefore has an escape wheel 23.

The axle member 24 is affixed coaxially to the escape wheel 23. A line through the axis of the axle member 24 is referred to as axis 25.

Below, the direction along the axis 25 is referred to as simply the axial direction, and the direction perpendicular to the axis 25 is the radial direction. The direction around the axis 25 is referred to as the circumferential direction.

In the radial direction, the axis 25 side is referred to as the inside circumference side, and the opposite side as the axis 25 side as the outside circumference side.

The diameter of the addendum circle of the escape wheel 23 is not specifically limited, but in this embodiment is approximately 5 mm.

As shown in FIG. 2 to FIG. 5, the escape wheel 23 is flat, and has a uniform thickness throughout. The surface on one side of the escape wheel 23 is referred to as the front surface 23*a*, and the surface on the other side is referred to as the back surface 23*b*. The escape wheel 23 is made from a brittle material with a crystal orientation, such as monocrystalline silicon. In this embodiment, the material used for the escape wheel 23 is monocrystalline silicon.

The escape wheel 23 has a rim 26, and multiple support parts 27.

The rim 26 is the part located at the outside circumference side of the escape wheel 23. The rim 26 has multiple teeth 28, and the teeth 28 are located on the outside circumference side. The teeth 28 are formed in a specific hook shaped configuration, and protrude to the outside in the radial direction.

The support parts 27 are located in the center part of the escape wheel 23. The support parts 27 support the axle member 24.

The support parts 27 are located on the axle member 24 side of the rim 26, and the number of support parts 27 is not specifically limited. In this embodiment, for example, the escape wheel 23 has seven support parts 27. In this embodiment, the support parts 27 are disposed around the circumference of the rim 26 at an equal angular spacing of 360/7 degrees. Note that the number of support parts 27 may be between three and seven, or seven or more, and is not specifically limited.

The support parts 27 include multiple first ribs 29, and multiple second ribs 30. The first ribs 29 are disposed to the rim 26 extending from the rim 26 to the axle member 24 side. The second ribs 30 are disposed between the multiple first ribs 29. The second ribs 30 are configured branching from the first ribs 29. The first ribs 29, second ribs 30, and rim 26 are integrally formed from the same material.

The axle member 24 is inserted through an area in the center of the escape wheel 23 surrounded by the support parts 27. A second hole 23*c* is configured by the support parts 27 as a second opening in the center of the escape wheel 23. The axle member 24 is inserted to this second hole 23*c*.

The second ribs 30 comprise leaf springs 31 and a pressure part 32 as multiple spring parts.

The leaf springs 31 are formed between the axle member 24 end of the second ribs 30, and where the second ribs 30 branch from the first ribs 29. The multiple leaf springs 31 are connected to the first ribs 29. Each of the leaf springs 31 is formed extending from a first rib 29. The leaf springs 31 are flat rectangular members, and the lengthwise direction of the leaf springs 31 intersects the lengthwise direction of the first ribs 29. The multiple leaf springs 31 are parallel to each other.

The pressure part 32 connects to the multiple leaf springs 31. The pressure part 32 is rod-shaped, and the lengthwise direction of the pressure part 32 is the direction from the rim 26 to the axle member 24.

The leaf springs 31 urge the pressure part 32, and the pressure part 32 applies pressure from multiple directions to the axle member 24. The multiple leaf springs 31 urge the pressure part 32, and the urged pressure part 32 pushes against the axle member 24.

Looking at the escape wheel 23 from the axial direction of the axle member 24, the first ribs 29 and pressure part 32 are long members extending to the outside of the radial direction in a radiating pattern. When the leaf springs 31 flex, force in the radial direction acts on the pressure part 32. The pressure part 32 then pushes against the axle member 24 due to the force from the leaf springs 31.

As shown in FIG. 2, the multiple teeth 28 of the escape wheel 23 engage the pallet 21. The pallet 21 includes a fork lever 33. The fork lever 33 has three lever beams 34 joined in a T shape. A round pallet staff 35 is disposed at the junction between the three lever beams 34. The ends of the pallet staff 35 are rotatably supported by the main plate 3 and a pallet bridge not shown. The fork lever 33 swings, pivoting on the pallet staff 35.

Of the three lever beams 34, a first pallet stone 36 is disposed to the distal end of the lever beam 34 on the right side in the figure. Of the three lever beams 34, a second pallet stone 37 is disposed to the distal end of the lever beam 34 on the left side in the figure. Of the three lever beams 34, a guard pin 38 is disposed to the lever beam 34 at the top in the figure.

The first pallet stone 36 and second pallet stone 37 are rubies shaped as rectangular columns, and are bonded to the lever beams 34 by adhesive in this example.

When the pallet 21 rocks on the pallet staff 35, the first pallet stone 36 or second pallet stone 37 contacts one of the teeth 28 of the escape wheel 23. At this time the lever beam 34 to which the guard pin 38 is attached contacts a banking pin 41. The banking pin 41 is a columnar pin affixed to the main plate 3. By the lever beam 34 contacting the banking pin 41, the pallet 21 is prevented from turning further in the same direction. As a result, rotation of the escape wheel and pinion 18 is temporarily stopped.

As shown in FIG. 3 to FIG. 5, the axle member 24 has a first pivot 42, a guide 43, a first shaft 44, a second shaft 45, and a second pivot 46. The first pivot 42, guide 43, first shaft 44, second shaft 45, and second pivot 46 are disposed in the same order in the axial direction. The first pivot 42, guide 43, first shaft 44, second shaft 45, and second pivot 46 are disposed in unison coaxially to each other.

The axle member 24 is made from carbon steel with excellent rigidity and heat resistance, and excellent processability, including cutting, machining, and grinding. The material used for the axle member 24 may also be tantalum (Ta) or tungsten (W) instead of carbon steel.

The first pivot 42 and second pivot 46 are formed at opposite axial ends of the axle member 24. The first pivot 42 and second pivot 46 have a round rod shape, and function as pivots when the axle member 24 turns.

The surface of the escape wheel 23 on the first pivot 42 side is the front surface 23*a*, and the surface on the second pivot 46 side is the back surface 23*b*. The first pivot 42 is supported rotatably by the main plate 3, and the second pivot 46 is supported rotatably by a wheel train bridge not shown.

Multiple teeth 47 are formed on the second shaft 45. All tooth forms from the tip 47*a* to the root 47*b* of the teeth 47 are formed in the second shaft 45. The second shaft 45 functions as a pinion. The second shaft 45 also meshes with the gear teeth of the fourth wheel 15. As a result, torque from the fourth wheel 15 is transferred to the axle member 24, and the escape wheel and pinion 18 turns.

On the first shaft 44 and the guide 43, the teeth 47 are formed from the root 47*b* to a point between the root 47*b* and the tip 47*a*. In the guide 43, first shaft 44, and second shaft 45, there are grooves 24*a* in the part from the root 47*b* to a point between the root 47*b* and tip 47*a*. The first shaft 44 therefore has grooves 24*a* along the axial direction of the first shaft 44.

The axle member 24 is divided in the circumferential direction into seven equal parts by the grooves 24*a*. Therefore, a grooves 24*a*, tips 47*a*, and roots 47*b* are located at seven locations spaced equidistantly 360/7 degrees circumferentially around the second pivot 46 side of the axle member 24.

The number of teeth on the second shaft 45 is not specifically limited, but in this embodiment there are seven teeth 47. The teeth 47 are disposed at seven locations 360/7 degrees apart circumferentially around the second shaft 45. The roots 47*b* and grooves 24*a* extend from the first shaft 44 to the second shaft 45. The roots 47*b* are therefore disposed to the first shaft 44 at seven locations 360/7 degrees apart circumferentially around the first shaft 44.

As shown in FIG. 5, the diameter of the first shaft 44 is first diameter 44*a*. The diameter of the second shaft 45 is second diameter 45*a*. The second diameter 45*a* is greater than the first diameter 44*a*.

The side of the first shaft 44 is referred to as first side surface 44*b*. The side of the second shaft 45 is referred to as second side surface 45*b*.

A seat 48 is formed on the axle member 24 at the interface between the first side surface 44*b* and the second side surface 45*b*, that is, on the outside of the position where the first shaft 44 and second shaft 45 connect. The seat 48 is a surface perpendicular to the axis 25. Note that the maximum diameter is not limited to a circular shape, and conceptually includes forms of which, relative to the shape of a comparison shape, at least part of the outside shape is larger than the outside shape of the comparison.

A guide member 49, escape wheel 23, and a fixing member 50 are disposed in this order to the first shaft 44 from the seat 48 side to the guide 43. The escape wheel 23 is disposed between the guide member 49 and the fixing member 50.

The fixing member 50 is fixed to the first shaft 44. The guide member 49 is disposed in contact with the seat 48. The guide member 49 and escape wheel 23 are also disposed between the seat 48 and the fixing member 50. The guide member 49 and escape wheel 23 are fixed between the seat 48 and the fixing member 50.

The guide member 49 and the fixing member 50 are similarly shaped. The color of the guide member 49 and the color of the fixing member 50 may be different colors. During assembly, this helps prevent assembling the guide member 49 and fixing member 50 in the wrong order. Color can be imparted to the guide member 49 and fixing member 50 by plating, for example. Alternatively, the guide member 49 and fixing member 50 may be differentiated by forming the guide member 49 and fixing member 50 with different thicknesses.

The guide 43 is disposed on the front surface 23*a* side of the escape wheel 23. The guide 43 is formed on the first pivot 42 end of the first shaft 44, that is, on the opposite end as the second shaft 45. The diameter of the guide 43 is greater than the diameter of the first pivot 42. The guide 43 functions to guide the axle member 24 during insertion of the axle member 24 to the guide member 49, escape wheel 23, and fixing member 50.

The guide 43 is shaped so that the diameter decreases with distance from the first shaft 44 to the first pivot 42 end. Roots 47*b* and grooves 24*a* are also formed on the guide 43.

Figure 6:
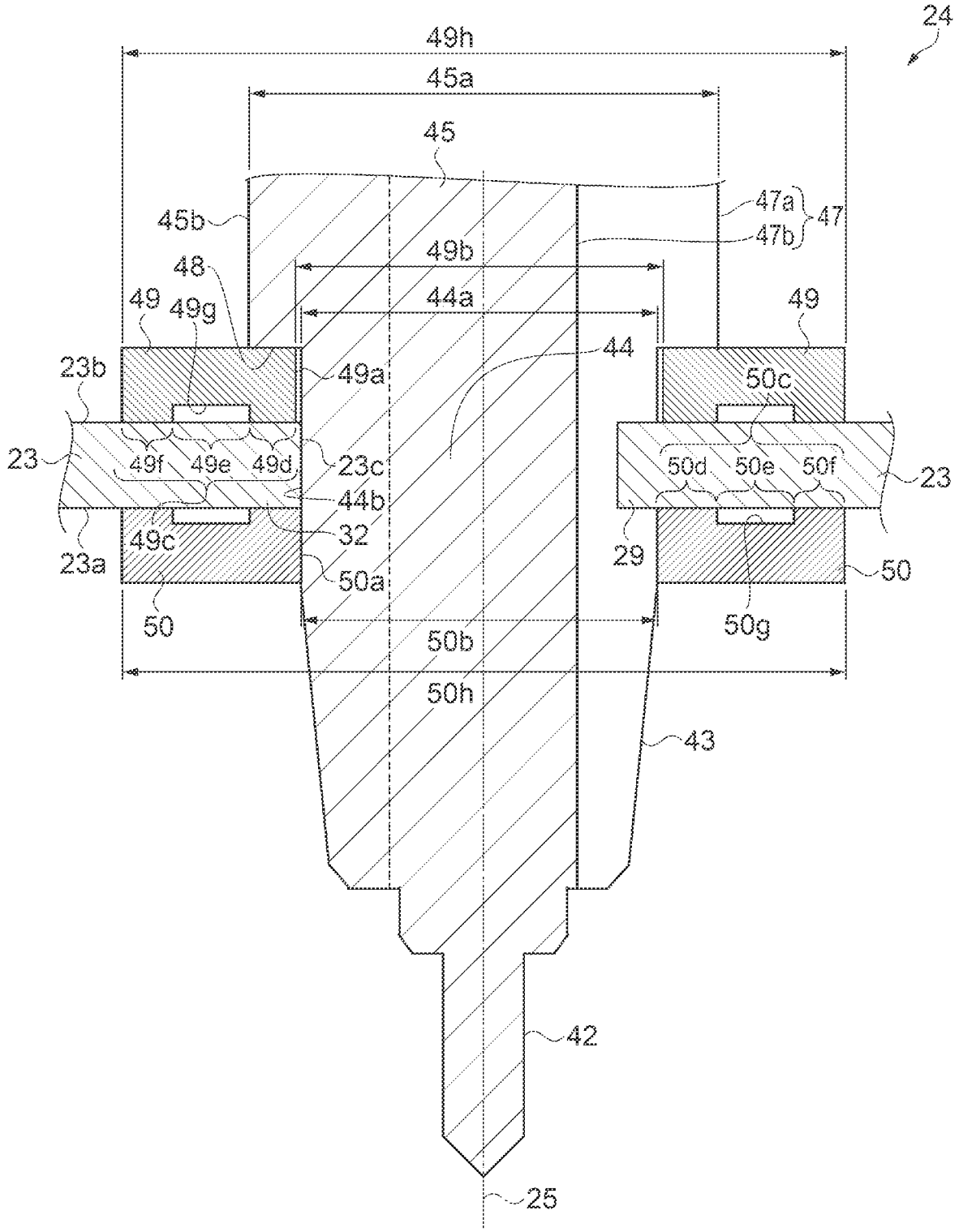
FIG. 6 is a schematic side section view of main parts describing the fixing structure of the guide member, escape wheel, and fixing member.

FIG. 6 is a schematic side section view of main parts describing the fixing structure of the guide member, escape wheel, and fixing member.

As shown in FIG. 6, the guide member 49 has a first hole 49*a* as a first opening, and the first shaft 44 is inserted to the first hole 49*a*. The diameter of the first hole 49*a* is a first hole diameter 49*b*. The first hole diameter 49*b* is greater than the first diameter 44*a*.

The guide member 49 slides easily along the first side surface 44*b*. As a result, the guide member 49 can be set in contact with the seat 48 with no gap therebetween.

The length of the guide member 49 in the radial direction of the axle member 24 is guide member diameter 49*h*. The guide member diameter 49*h* is greater than the second diameter 45*a*.

Figure 7:
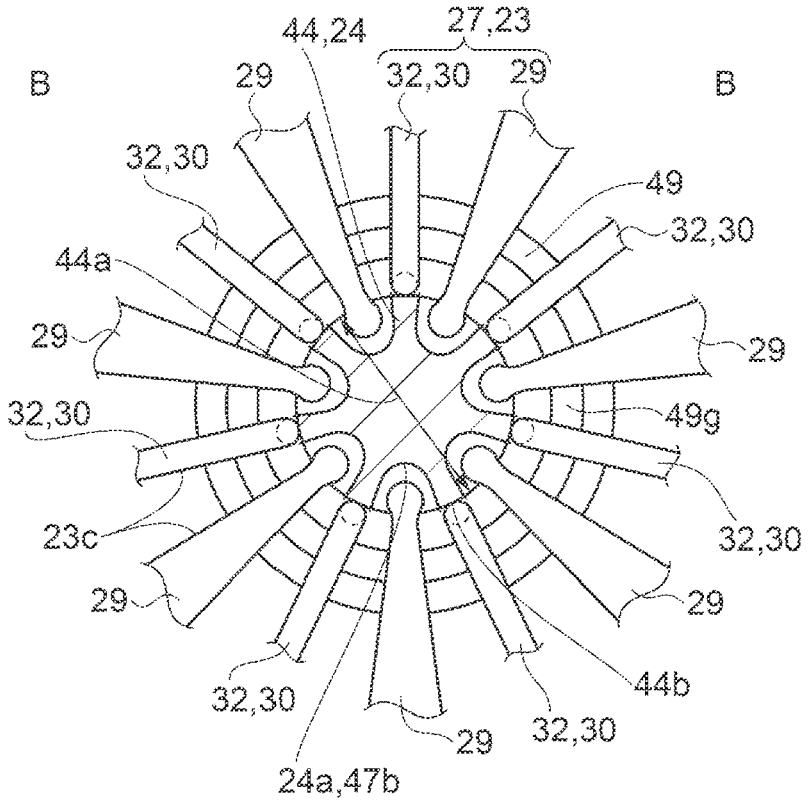
FIG. 7 is a schematic plane section view of main parts describing the relative positions of a first axle, guide member, and escape wheel.

Note that the shape of the first hole 49*a* in the guide member is round, but the first hole 49*a* in the guide member may be shaped similarly to the contour of the roots 47*b* and grooves 24*a*, that is, the outside shape of the first shaft 44 in cross section as shown in FIG. 7. The fixing member 50 may likewise be shaped similarly to the contour of the roots 47*b* and grooves 24*a*, that is, the outside shape of the first shaft 44 in cross section.

The surface of the guide member 49 that contacts the escape wheel 23 is referred to as the guide contact surface 49*c*.

The part on the first shaft 44 side of the guide contact surface 49*c* is referred to as the inside circumference guide surface 49*d*.

The part on the outside circumference side of the guide contact surface 49*c* is referred to as the outside circumference guide surface 49*f*.

The part of the guide contact surface 49*c* between the inside circumference guide surface 49*d* and the outside circumference guide surface 49*f* is referred to as the middle guide surface 49*e*.

The middle guide surface 49*e* is recessed from the inside circumference guide surface 49*d* and outside circumference guide surface 49*f*, forming an annular guide member groove 49*g*.

The escape wheel 23 is disposed in contact with the guide member 49. The inside circumference guide surface 49*d* and outside circumference guide surface 49*f* contact the escape wheel 23, and the middle guide surface 49*e* is separated from the escape wheel 23.

The seven pressure parts 32 of the escape wheel 23 push against the first shaft 44. The pressure parts 32 and first ribs 29 of the escape wheel 23 contact the guide member 49.

A third hole 50*a* as a third opening is formed in the fixing member 50, and the first shaft 44 is inserted to the third hole 50*a*. The length of the fixing member 50 in the radial direction of the axle member 24 is referred to as fixing member diameter 50*h*. The fixing member diameter 50*h* is greater than the second diameter 45*a*.

The fixing member 50 is disposed in contact with the escape wheel 23. The diameter of the third hole 50*a* is referred to as third hole diameter 50*b*. The third hole diameter 50*b* is smaller than the first diameter 44*a*. As a result, the fixing member 50 is tightly fit to the first shaft 44.

Note that the fixing member 50 may be annular or a C ring. If the fixing member 50 is a C ring, the fixing member 50 being tightly fit includes the first shaft 44 being held and fixed by the fixing member 50. This fixing method, more specifically being tightly fit, enables fixing the escape wheel 23 to the axle member 24 without using adhesive.

The first hole diameter 49*b*, which is the diameter of the first hole 49*a*, is greater than the first diameter 44*a*. Therefore, deformation of the guide member 49 when the guide member 49 is inserted to the first shaft 44 can be reduced.

The fixing member 50 is also tightly fit to the axle member 24. Therefore, the guide member 49 and escape wheel 23 can be held in mutual contact by the fixing member 50 pushing against the escape wheel 23. The escape wheel 23 can also be held in contact with the fixing member 50. As a result, the angle of the plane direction of the escape wheel 23 to the axis 25 of the axle member 24 can be controlled by the guide member 49 and the fixing member 50.

The seat 48 of the axle member 24 is in contact with the guide member 49, and the guide member 49 is in contact with the escape wheel 23. The escape wheel 23 is also in contact with the fixing member 50, and the fixing member 50 is fixed to the axle member 24. The escape wheel 23 is therefore held between the guide member 49 and the fixing member 50.

Supporting the escape wheel 23 at a position separated from the axis 25 of the first shaft 44 enables holding the angle of the plane direction of the escape wheel 23 to the axis of the first shaft 44 closer to perpendicular than when the escape wheel 23 is held at a position close to the axis 25 of the first shaft 44. The length of the guide member 49 in the radial direction of the axle member 24 is greater than the second diameter 45*a*. Therefore, disposing the guide member 49 between the seat 48 and the escape wheel 23 enables holding the angle of the plane direction of the escape wheel 23 to the axis of the first shaft 44 closer to perpendicular than when the escape wheel 23 is disposed in contact with the seat 48.

The fixing member diameter 50*h* is also greater than the second diameter 45*a*. Therefore, using a fixing member 50 that is larger than the second diameter 45*a* enables holding the angle of the plane direction of the escape wheel 23 to the axis of the first shaft 44 closer to perpendicular than when the fixing member diameter 50*h* is equal to the second diameter 45*a*.

The closer the angle of the plane direction of the escape wheel 23 to the axis 25 of the first shaft 44 is to perpendicular, the less the runout of the escape wheel 23 in the axial direction when the axle member 24 turns. Axial runout of the escape wheel 23 when the axle member 24 turns can therefore be reduced.

Compared with holding the escape wheel 23 between the seat 48 and fixing member 50, holding the escape wheel 23 between the guide member 49 and the fixing member 50 increases the surface area holding the escape wheel 23 when seen on the axial direction of the axle member 24. The guide member 49 and fixing member 50 can therefore reliably hold the escape wheel 23. As a result, guide member 49 and fixing member 50 can hold the escape wheel 23 stably. In addition, because the area of contact between the escape wheel 23 and the guide member 49 can be increased by providing a guide member 49, cracking and chipping of the escape wheel 23 can be suppressed.

The surface of the fixing member 50 on the side that contacts the escape wheel 23 is referred to as the fixing contact surface 50*c*.

In the fixing contact surface 50*c*, the inside circumference part on the first shaft 44 side is referred to as the inside circumference fixing surface 50*d*.

The outside circumference part on the outside circumference side is referred to as the outside circumference fixing surface 50*f*.

The middle part between the inside circumference fixing surface 50*d* and outside circumference fixing surface 50*f* is referred to as the middle fixing surface 50*e*. The middle fixing surface 50*e* is recessed from the inside circumference fixing surface 50*d* and outside circumference fixing surface 50*f*, forming an annular fixing member groove 50*g*.

The inside circumference fixing surface 50*d* and outside circumference fixing surface 50*f* contact the escape wheel 23, and the middle fixing surface 50*e* is separated from the escape wheel 23. The fixing member 50 therefore has a recess in the surface that contacts the escape wheel 23, forming a groove where the fixing member 50 does not contact the escape wheel 23.

Because the inside circumference fixing surface 50*d* is not recessed, a large contact area between the fixing member 50 and first shaft 44 can be assured.

If the middle fixing surface 50*e* is not recessed, the middle fixing surface 50*e* may contact the escape wheel 23 and the outside circumference fixing surface 50*f* may not contact the escape wheel 23 due to deviation in the flatness of the middle fixing surface 50*e*. However, when the middle fixing surface 50*e* is recessed, the middle fixing surface 50*e* does not contact the escape wheel 23, and the outside circumference fixing surface 50*f* can reliably contact the escape wheel 23. As a result, the fixing member 50 can contact the escape wheel 23 at a part separated from the first shaft 44. In addition, the parts of the fixing member 50 that are not recessed can reliably contact the escape wheel 23.

The material of the guide member 49 is preferably an iron alloy or a titanium alloy. The guide member 49 in this embodiment of the invention is made from carbon steel. Iron alloys and titanium alloys have high stiffness, and therefore are not easily deformed.

The escape wheel 23 preferably contains silicon. The escape wheel 23 in this example contains silicon, which is a brittle material. The hardness of the escape wheel 23 is therefore high, and is more difficult to deform than the guide member 49.

The material used for the fixing member 50 is preferably copper, a copper alloy, aluminum, or an aluminum alloy. Copper, copper alloys, aluminum, and aluminum alloys are materials that deform more easily than the materials used for the guide member 49 and escape wheel 23.

The first shaft 44 is inserted to the guide member 49, escape wheel 23, and fixing member 50, and the fixing member 50 is pressed to the seat 48 side. The seat 48 and guide member 49 are made to contact each other by this pressure.

The guide member 49 and escape wheel 23 are similarly made to contact. The escape wheel 23 and fixing member 50 are also similarly made to contact. At this time the fixing member 50 can be fixed to the first shaft 44 without deforming the guide member 49 and escape wheel 23. As a result, the angle of the plane direction of the escape wheel 23 to the axis of the first shaft 44 can be made closer to perpendicular.

FIG. 7 is a schematic plane section view along line B-B in FIG. 5 illustrating the relative positions of the first shaft, guide member, and escape wheel.

As shown in FIG. 7, the escape wheel 23 has seven first ribs 29 and seven pressure parts 32 disposed radiating toward the first shaft 44. The seven first ribs 29 and seven pressure parts 32 alternate circumferentially around the axle member 24. The part of the escape wheel 23 surrounded by the first ribs 29 and pressure parts 32 is a hole. This hole is referred to as second hole 23*c*. The first shaft 44 is inserted to the second hole 23*c*. In other words, the escape wheel 23 has a second hole 23*c* through which the first shaft 44 is inserted.

The ends of the first ribs 29 are disposed in the grooves 24*a*.

The pressure parts 32 have leaf springs 31 that urge the pressure parts 32, and the pressure parts 32 push the first shaft 44 from seven directions. The ends of the second ribs 30 therefore push against the axle member 24.

The grooves 24*a* are formed as channels recessed in the radial direction of the axle member 24 to the inside from the tips 47*a*.

Because the ends of the first ribs 29 are disposed in the grooves 24*a*, the first ribs 29 are reliably fixed between the guide member 49 and fixing member 50.

When the axle member 24 turns, the first ribs 29 transfer torque from the axle member 24 to the rim 26, causing the rim 26 to turn.

The pressure parts 32 of the second ribs 30 branch from the first ribs 29. Because there are seven first ribs 29, seven second ribs 30 are also provided. The second ribs 30 have leaf springs 31, and hold the axle member 24 by applying pressure to the axle member 24 from seven directions.

Because seven second ribs 30 push against the first shaft 44, the internal stress of the individual second ribs 30 can be reduced.

The escape wheel 23 is made of silicon, which is a brittle material. However, the torque received from the axle member 24 is received by the first ribs 29, and the force pushing to hold the axle member 24 is dispersed and received by the seven second ribs 30. Damage to the support part 27 due to stress can therefore be reduced.

The ends of the seven pressure parts 32 are disposed to positions contacting the circle of the first side surface 44*b*. This circle is concentric to the addendum circle of the teeth 28. Therefore, when the axle member 24 turns, the teeth 28 rotate centered on the axis 25.

Figure 8:
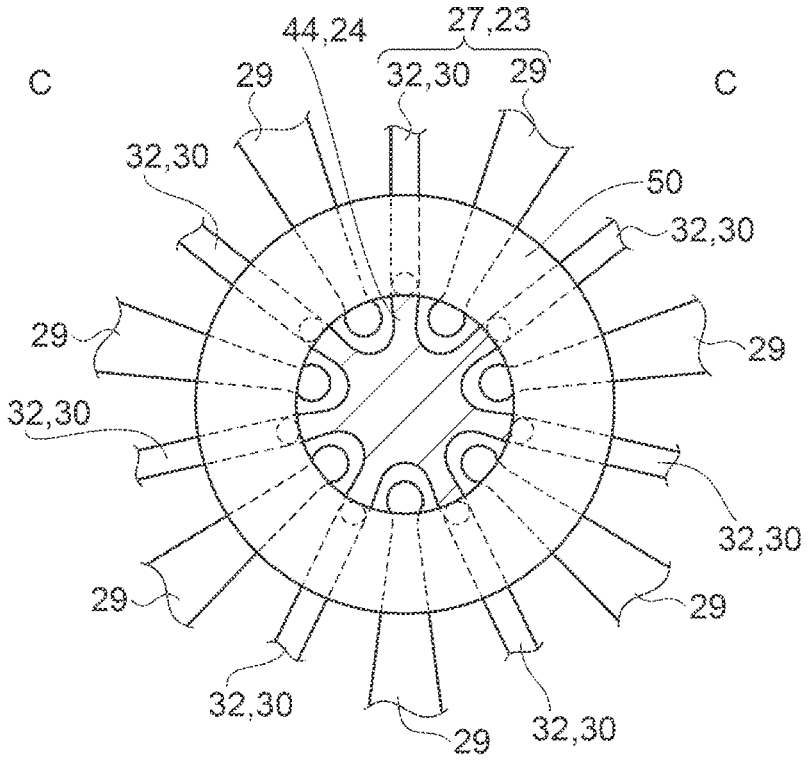
FIG. 8 is a schematic plane section view of main parts describing the relative positions of a first axle, escape wheel, and fixing member.

FIG. 8 is a schematic plane section view along line C-C in FIG. 5 illustrating the relative positions of the first shaft, escape wheel, and fixing member.

As shown in FIG. 8, the support part 27 of the escape wheel 23 overlaps the guide member 49 and fixing member 50 in a plan view along the axial direction of the axle member 24. When the escape wheel 23 is disposed between the guide member 49 and fixing member 50, the guide member 49 and fixing member 50 hold the first ribs 29 and pressure parts 32 therebetween. Because there are seven each of the first ribs 29 and pressure parts 32, the guide member 49 and fixing member 50 hold the escape wheel 23 at fourteen locations. The first ribs 29 and pressure parts 32 are also disposed in a radiating pattern from the first shaft 44. The guide member 49 and fixing member 50 can therefore reliably support the first shaft 44 side of the escape wheel 23 without bias.

Method of Manufacturing the Escape Wheel

A method of manufacturing the escape wheel and pinion 18 is described next.

Figure 9:
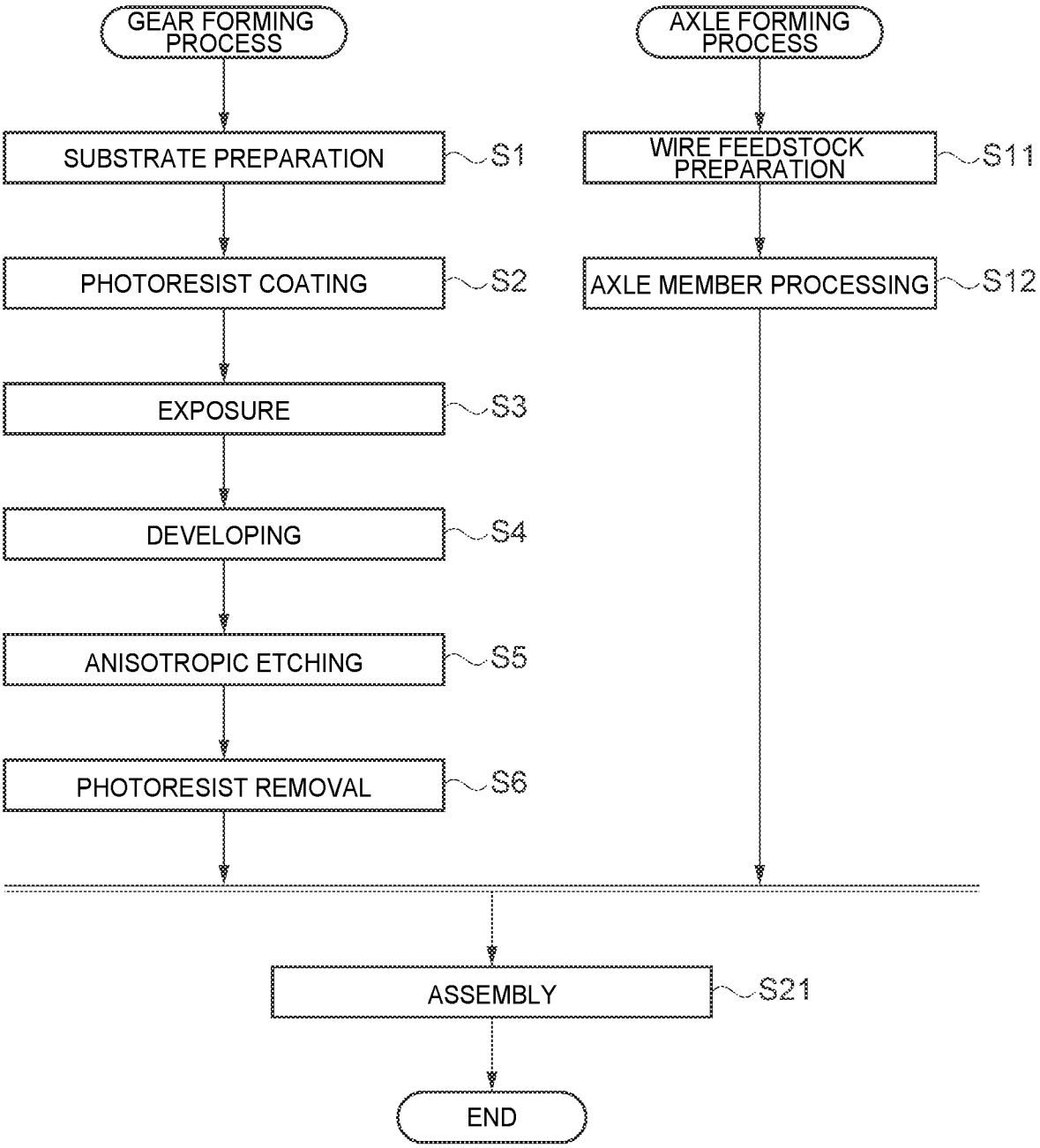
FIG. 9 is a flow chart of the escape wheel manufacturing method.

FIG. 9 is a flow chart of a method of manufacturing an escape wheel according to the invention. As shown in FIG. 9, the manufacturing method of the escape wheel and pinion 18 includes a gear forming process of forming the escape wheel 23, an axle forming process of forming the axle member 24, and an assembly process of inserting the axle member 24 to the escape wheel 23, forming the escape wheel and pinion 18.

The gear forming process is a process of forming the support part 27, rim 26, and teeth 28 of the escape wheel 23, and includes step S1 to step S6.

Step S1 is the substrate preparation step. This step is a process of preparing a wafer made of silicon. Next is step S2.

Step S2 is a photoresist coating step. This is a process of coating the surface of the substrate with a photoresist in a specific pattern by a spin coating or spray coating method. The applied photoresist may be a negative or a positive photoresist. Next is step S3.

Step S3 is an exposure step. This is a process of exposing the photoresist applied to the surface of the substrate. Next is step S4.

Step S4 is a developing process. This process develops the photoresist. As a result, a photoresist pattern that functions as an etching mask corresponding to the desired plane shape of the escape wheel 23 is formed. The plane shape of the escape wheel 23 includes the support part 27 and rim 26. Control then goes to step S5.

Step S5 is an anisotropic etching process. This step is a process of applying anisotropic etching to the substrate using the photoresist pattern as a mask. Deep Reactive Ion Etching (DRIE) is used for anisotropic etching in this example. This method etches the substrate substantially perpendicularly from the surface according to the photoresist pattern, and produces the outside shape of an escape wheel 23 having a rim 26 with multiple teeth 28, and a support part 27 including first ribs 29 and second ribs 30. Control then goes to step S6.

Step S6 is a photoresist removal process. This step is a process of removing the photoresist pattern. For example, the photoresist can be removed by wet etching using white fuming nitric acid (WFNA) or an organic solvent capable of dissolving and removing the photoresist, or oxygen plasma asking.

These processes complete formation of the escape wheel 23.

Control then goes to step S21.

As described above, by making the substrate of the escape wheel 23 from silicon, parts of the escape wheel 23 such as the first ribs 29, second ribs 30, and rim 26 can be formed in the same etching process from the same substrate material, and multiple escape wheels 23 can be made from a single substrate. As a result, the productivity of escape wheel 23 manufacture can be improved, and the production cost can be reduced. Furthermore, because the escape wheel 23 is manufactured using photolithography and etching technologies, the shape of individual parts can be formed as desired, and manufacturing precision can be improved.

The axle forming process is a process of forming the first pivot 42, guide 43, first shaft 44, second shaft 45, and second pivot 46 on the axle member 24. The axle forming process includes step S11 and step S12. The axle forming process is run separately from the gear forming process.

Step S11 is the axle member preparation step. This is a process of preparing the wire material (feedstock) from which the axle member 24 is made. The feedstock of the axle member 24 preferably has sufficient stiffness and heat resistance as an axle. In addition to being a material with excellent stiffness and heat resistance, carbon steel also has excellent processability, including cutting and grinding, and is particularly well suited as a material for the axle member 24. Next is step S12.

Step S12 is the axle member processing step. This step is a process of cutting, grinding, or otherwise machining the member that will be the axle member 24. The feedstock is placed in a lathe, and the feedstock is turned on its axis. A bit or other cutting tool is then set against the rotating workpiece. The bit is then moved according to the desired shape of the second pivot 46. As a result, the second pivot 46 is shaped and the axle member 24 before the teeth 47 are formed is formed. The axle member 24 before the teeth 47 are formed is the axle member with uncut teeth. The portion without teeth is then severed from the feedstock.

The teeth 47 are then formed in the axle member without teeth. The axle member with the outside shape of the axle member 24 and uncut teeth is then placed in a gear cutter. The gear cutter moves a cutting tool corresponding to the desired form of the teeth 47 in the axial direction of the axle member without teeth. As a result, the teeth 47 are formed on the axle member 24.

Next, nickel plating, for example, is applied to the axle member 24. These processes complete formation of the axle member 24. Control then goes to step S21.

Step S21 is the assembly process. In this process the guide member 49, escape wheel 23, and fixing member 50 are fit onto the axle member 24. The fixing member 50 is then fit onto the first shaft 44. The axle member 24 is then inserted to the escape wheel 23, completing the escape wheel and pinion 18 assembly.

Figure 10:
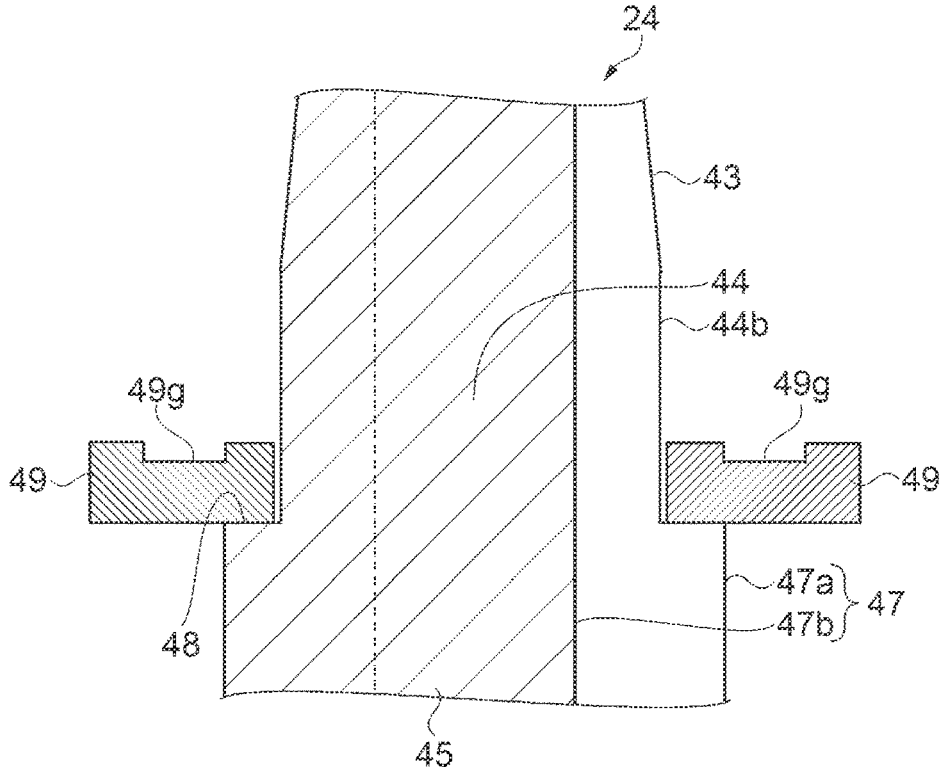
FIG. 10 is a side section view used to describe the assembly process.
Figure 11:
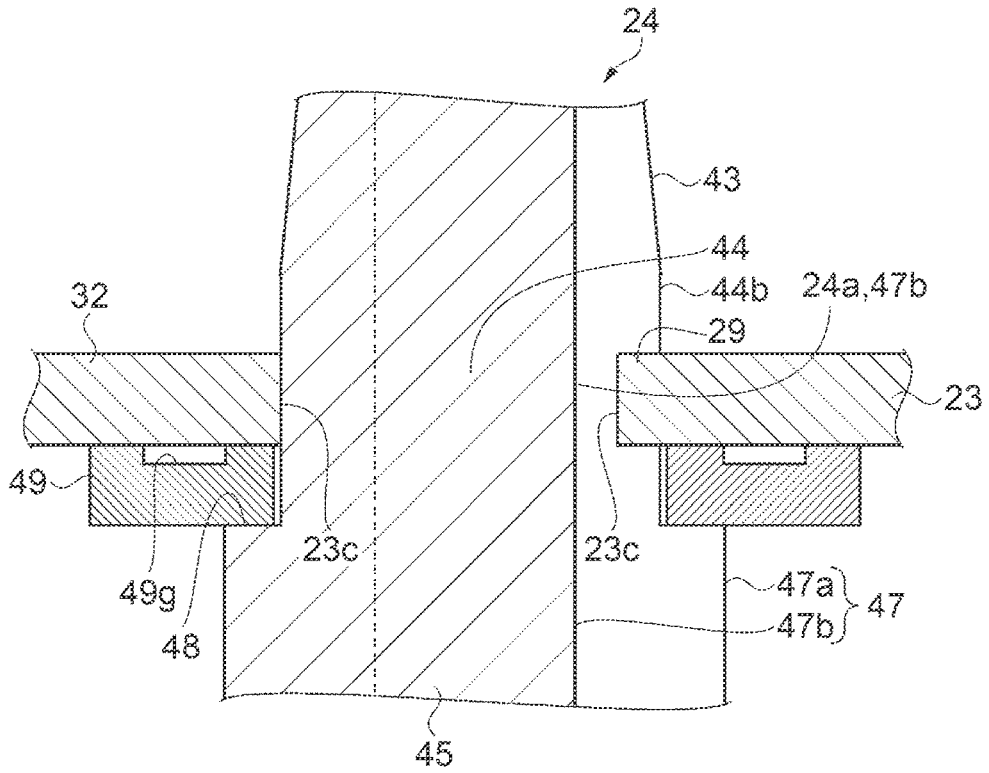
FIG. 11 is a side section view used to describe the assembly process.
Figure 12:
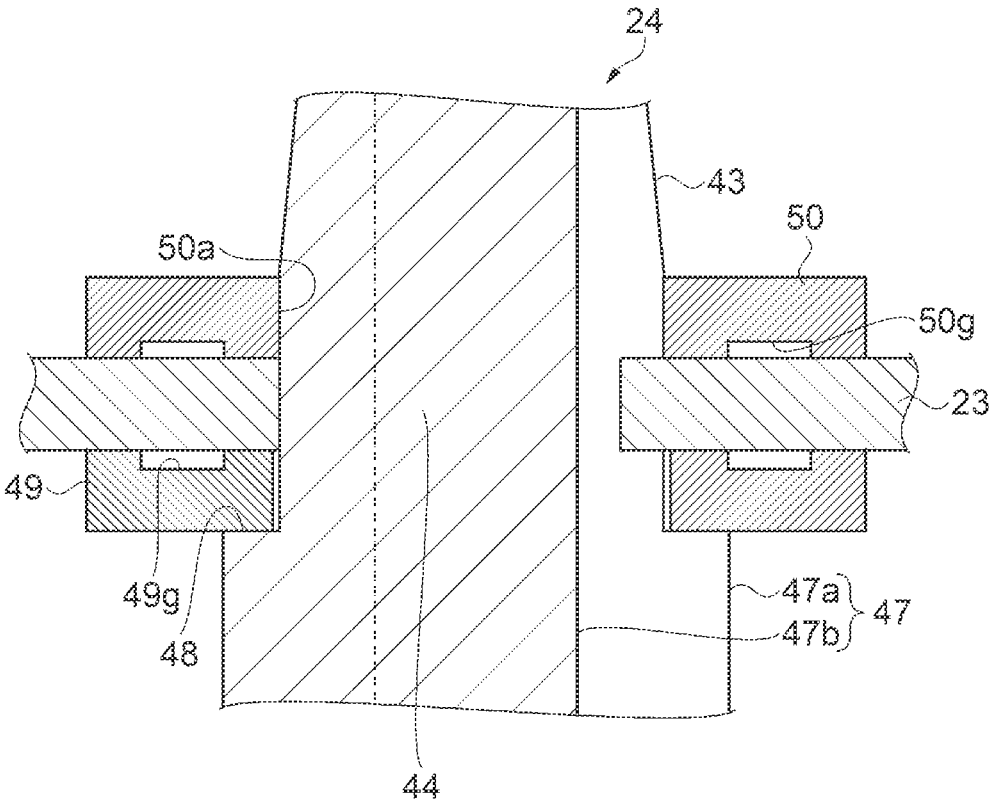
FIG. 12 is a side section view used to describe the assembly process.

The assembly process shown in step S21 is described next with reference to FIG. 10 to FIG. 12. FIG. 10 to FIG. 12 are side section views illustrating the assembly process. Note FIG. 10 to FIG. 12 illustrate pushing the guide member 49, escape wheel 23, and fixing member 50 onto the axle member 24, but the axle member 24 may instead be inserted to the guide member 49, escape wheel 23, and fixing member 50.

As shown in FIG. 10, the guide member 49 is fit onto the first shaft 44 from the guide 43 side of the axle member 24. The first hole diameter 49*b* is larger than the first diameter 44*a*. The fitting tolerance of the first shaft 44 and guide member 49 is set to a clearance fit. As a result, the first shaft 44 can be easily inserted to the guide member 49. The guide member 49 contacts the seat 48. The guide member 49 is aligned so that the guide member grooves 49*g* face the guide 43.

Next, as shown in FIG. 11, the second hole 23*c* of the escape wheel 23 is fit over the first shaft 44 from the guide 43 side of the axle member 24. At this time the first ribs 29 and grooves 24*a* are aligned in the circumferential direction of the first shaft 44. The axle member 24 and escape wheel 23 are then assembled so that the pressure part 32 pushes against the first side surface 44*b*.

The second hole 23*c* is first fit to the guide 43 from the first pivot 42. Next, the first ribs 29 are aligned with the grooves 24*a*. The pressure parts 32 are then set against the outside circumference of the guide 43.

Next, the escape wheel 23 is pushed to the guide member 49. The diameter of the outside circumference of the guide 43 is greater on the seat 48 side than the first pivot 42 side.

Before the escape wheel 23 is fit on the axle member 24, the diameter of the inscribed circle of the pressure parts 32 is smaller than the first diameter 44*a*. Because the pressure parts 32 are supported by the leaf springs 31, the pressure parts 32 can move in the radial direction of the escape wheel 23. As a result, when the escape wheel 23 approaches the guide member 49, the pressure parts 32 spread gradually to the outside in the radial direction.

As a result, the escape wheel 23 moves from the guide 43 to the first shaft 44. The pressure parts 32 are also touching the first side surface 44*b*. Because the pressure parts 32 are urged by the leaf springs 31, the pressure parts 32 push against the first shaft 44.

Next, as shown in FIG. 12, the third hole 50*a* of the fixing member 50 is fit to the first shaft 44 from the guide 43 side of the axle member 24. As described above, the third hole diameter 50*b* is smaller than the first diameter 44*a*. The fitting tolerance of the first shaft 44 and fixing member 50 allows for a tight fit. As a result, the fixing member 50 is press fit to the first shaft 44, and the fixing member 50 is thereby tightly fit to the first shaft 44.

These steps complete production of the escape wheel and pinion 18.

Effects of the foregoing embodiment are described below.

(1) In the embodiment described above, the escape wheel and pinion 18 has an axle member 24, and the axle member 24 is shaped so that the first side surface 44*b* of the first shaft 44 and the second side surface 45*b* of the second shaft 45 connect through a seat 48. The second diameter 45*a*, which is the diameter of the second shaft 45, is greater than the first diameter 44*a*, which is the diameter of the first shaft 44.

Half of the length of the second diameter 45*a* minus the first diameter 44*a* is the width of the seat 48.

The guide member 49 has a first hole 49*a*. The escape wheel 23 has a second hole 23*c*. The fixing member 50 has a third hole 50*a*.

The first hole 49*a* of the guide member 49, the second hole 23*c* of the escape wheel 23, and the third hole 50*a* of the fixing member 50 are fit onto the first shaft 44. The guide member 49, escape wheel 23, and fixing member 50 are disposed in order from the second shaft 45 side.

The seat 48 of the axle member 24 contacts the guide member 49, and the guide member 49 contacts the escape wheel 23. The escape wheel 23 and the fixing member 50 are in contact, and the fixing member 50 is fixed to the first shaft 44. The escape wheel 23 therefore is held between the guide member 49 and fixing member 50.

Supporting the escape wheel 23 at a position separated from the axis 25 of the first shaft 44 enables holding the angle of the plane direction of the escape wheel 23 to the axis of the first shaft 44 closer to perpendicular than when the escape wheel 23 is held at a position close to the axis 25 of the first shaft 44. The length of the guide member 49 in the radial direction of the axle member 24 is greater than the second diameter 45*a*. Therefore, disposing the guide member 49 between the seat 48 and the escape wheel 23 enables holding the angle of the plane direction of the escape wheel 23 to the axis of the first shaft 44 closer to perpendicular than when the escape wheel 23 is disposed in contact with the seat 48.

The length of the fixing member 50 in the radial direction of the axle member 24 is greater than the second diameter 45*a*. Therefore, using a fixing member 50 that is larger than the second diameter 45*a* enables holding the angle of the plane direction of the escape wheel 23 to the axis of the first shaft 44 closer to perpendicular than when length of the fixing member 50 in the radial direction of the axle member 24 is equal to the second diameter 45*a*.

The closer the angle of the plane direction of the escape wheel 23 to the axis 25 of the first shaft 44 is to perpendicular, the less the runout of the escape wheel 23 in the axial direction when the axle member 24 turns. Axial runout of the escape wheel 23 when the axle member 24 turns can therefore be reduced.

The guide member 49 and fixing member 50 hold the first ribs 29 and pressure parts 32 therebetween to support the escape wheel 23. When a guide member 49 is not provided, escape wheel 23 is supported with the first ribs 29 and pressure parts 32 between the seat 48 and fixing member 50.

Compared with this configuration, the guide member 49 and fixing member 50 in the configuration of this embodiment of the invention hold the escape wheel 23 by supporting a wider area of the first ribs 29 and pressure parts 32. The guide member 49 and fixing member 50 can therefore stably support the escape wheel 23.

(2) In this embodiment of the invention the first hole diameter 49*b*, which is the diameter of the first hole 49*a*, is greater than the first diameter 44*a*. Therefore, deformation of the guide member 49 can be reduced when the guide member 49 is inserted to the first shaft 44.

The fixing member 50 is tightly fit to the axle member 24. The guide member 49 and escape wheel 23 can be set in contact by pushing the fixing member 50 on the first shaft 44 to the escape wheel 23. The escape wheel 23 and fixing member 50 can also be made to contact. As a result, the angle of the plane direction of the escape wheel 23 to the axis 25 of the axle member 24 can be determined by the guide member 49 and fixing member 50.

(3) The guide member 49 in this embodiment of the invention is made from an iron alloy or a titanium alloy. Iron alloys and titanium alloys have high stiffness, and therefore are not easily deformed.

The escape wheel 23 in this example contains silicon, which is a brittle material. The hardness of the escape wheel 23 is therefore high, and is more difficult to deform than the guide member 49.

The material used for the fixing member 50 is preferably copper, a copper alloy, aluminum, or an aluminum alloy. The fixing member 50 is therefore made from a material that deforms more easily than the guide member 49 and escape wheel 23.

The first shaft 44 is inserted to the guide member 49, escape wheel 23, and fixing member 50, and the fixing member 50 is pressed to the seat 48 side. The seat 48 and guide member 49 are made to contact each other by this pressure.

The guide member 49 and escape wheel 23 are similarly made to contact. The escape wheel 23 and fixing member 50 are also similarly made to contact. At this time the fixing member 50 can be fixed to the first shaft 44 without deforming the guide member 49 and escape wheel 23. As a result, the angle of the plane direction of the escape wheel 23 to the axis of the first shaft 44 can be made closer to perpendicular.

(4) In this embodiment of the invention the fixing contact surface 50*c* of the fixing member 50 that contacts the escape wheel 23 has an inside circumference fixing surface 50*d*, middle fixing surface 50*e*, and an outside circumference fixing surface 50*f*.

The inside circumference fixing surface 50*d* is the first shaft 44 side. The outside circumference fixing surface 50*f* is the outside circumference side. The middle fixing surface 50*e* is a surface between the inside circumference fixing surface 50*d* and outside circumference fixing surface 50*f*. The middle fixing surface 50*e* is recessed from the inside circumference fixing surface 50*d* and outside circumference fixing surface 50*f*. As a result, the inside circumference fixing surface 50*d* and outside circumference fixing surface 50*f* contact the escape wheel 23, but the middle fixing surface 50*e* is separated from (does not contact) the escape wheel 23.

Because the inside circumference fixing surface 50*d* is not recessed, a large contact area between the fixing member 50 and first shaft 44 can be assured.

If the middle fixing surface 50*e* is not recessed, the middle fixing surface 50*e* may contact the escape wheel 23 and the outside circumference fixing surface 50*f* may not contact the escape wheel 23 due to deviation in the flatness of the middle fixing surface 50*e*. However, when the middle fixing surface 50*e* is recessed, the middle fixing surface 50*e* does not contact the escape wheel 23, and the outside circumference fixing surface 50*f* can reliably contact the escape wheel 23.

(5) In this embodiment of the invention the first shaft 44 has grooves 24*a*, and the grooves 24*a* are formed in the axial direction of the first shaft 44.

The escape wheel 23 also has a support part 27 and a rim 26. Because the rim 26 has multiple teeth 28, the escape wheel and pinion 18 functions as a gear.

The support part 27 holds the axle member 24. The support part 27 has first ribs 29 and second ribs 30. Multiple first ribs 29 are disposed to the rim 26 extending to the axle member 24 side. The ends of the first ribs 29 are disposed inside the grooves 24*a*, and the first ribs 29 are held between the guide member 49 and fixing member 50. When the axle member 24 turns, torque from the axle member 24 is transferred to the first ribs 29. The first ribs 29 transfer torque from the axle member 24 to the rim 26, causing the rim 26 to turn.

The second ribs 30 branch from the first ribs 29. Because there are multiple first ribs 29, there are also multiple second ribs 30. The second ribs 30 have leaf springs 31, and hold the axle member 24 by applying pressure to the axle member 24 from multiple directions.

Because multiple second ribs 30 push against the first shaft 44, the internal stress of the individual second ribs 30 can be reduced.

The escape wheel 23 is made of silicon, which is a brittle material. However, the torque received from the axle member 24 is received by the first ribs 29, and the force pushing to hold the axle member 24 is dispersed and received by the multiple second ribs 30. Damage to the support part 27 due to stress can therefore be reduced.

Note that the second ribs 30 are configured branching from the first ribs 29, but like the first ribs 29 may be disposed extending from the rim 26 to the axle member 24 side. By setting the distance between the ends of the second ribs 30 and the axle member 24 to assure a tight fight in this configuration, the second ribs 30 can push against the axle member 24 from multiple directions and hold the axle member 24. Alternatively, the second ribs 30 can be configured to hold the axle member 24 by providing a spring member on the second ribs.

(6) In this embodiment of the invention the second ribs 30 are disposed branching from the first ribs 29. Leaf springs 31 are disposed to a position between the ends of the second ribs 30 on the axle member 24 side, and where the second ribs 30 branch from the first ribs 29. Because the second ribs 30 have a spring member, the second ribs 30 can reliably urge the pressure part.

(7) A mechanical timepiece 1 according to this embodiment has an escape wheel and pinion 18 as described above. The escape wheel and pinion 18 thus comprised can reduce axial runout of the escape wheel 23 when the axle member 24 turns. A mechanical timepiece 1 that can reduce problems resulting from axial runout of the escape wheel 23 can therefore be provided.

Embodiments of the invention are not limited to the embodiment described above, and can be modified and improved in various ways that will be apparent to one skilled in the related art. Examples of some variations are described below.

Variation 1

The foregoing embodiment describes an escape wheel and pinion 18 that is used in an escapement of a mechanical timepiece as an example of a timepiece. The structure and manufacturing method of the invention can also be used in other timepiece parts that operate by power from the power source of the timepiece, including the pallet 21 and balance 22 used in the escapement; the barrel wheel 12, center wheel 13, third wheel 14, fourth wheel 15, and other wheels used in the front wheel train of the timepiece; and wheels used in the back wheel train.

The structure and manufacturing method of the invention can also be applied to electronic timepieces. The invention is also not limited to timepiece parts, and can be applied to parts of MEMS (Micro Electro Mechanical Systems).

The escape wheel, pallet, barrel complete, wheels, and MEMS parts applying the structure of the timepiece parts described above can reduce axial runout of flat members when the axle thereof turns.

Variation 2

In the foregoing embodiment the escape wheel 23 is a flat member made from silicon, which is a brittle. Alternatively, silicon carbide, quartz, glass, sapphire or other materials may be used for the escape wheel 23.

Variation 3

The foregoing embodiment describes a configuration in which the number of support parts 27 in the escape wheel 23 is seven, the same as the number of teeth 47 on the first shaft 44. More specifically, a configuration in which the number of first ribs 29 and second ribs 30 is seven is described. However, the number of support parts 27 and the number of teeth 47 on the first shaft 44 is not limited to the same number. The same effect as the embodiment described above can be achieved by configurations in which the number of support parts 27 is less than the number of teeth 47 on the first shaft 44.

Variation 4

In the manufacturing method of the escape wheel and pinion 18 described above, an oxidation process forming a silicon oxide film made from silicon dioxide ($SiO_2$) may be applied to the surface of the escape wheel 23 after the axle member 24 is inserted to the escape wheel 23 in step S21. Applying an oxidation process to the escape wheel 23 can improve the mechanical strength of the escape wheel 23 by the silicon oxide film formed on the surface of the escape wheel 23 from a material containing silicon. The oxidation process is preferably a thermal oxidation process at a high temperature such as 1000° C. or higher.

Variation 5

In the escape wheel 23 of the foregoing embodiment the leaf springs 31 urge the pressure parts 32. However, a coil spring, torsion bar, or other type of spring may be used instead of leaf springs 31.

Variation 6

A guide member groove 49*g* is disposed to the guide member 49 in the embodiment described above. If the surface of the guide member 49 that contacts the escape wheel 23 is smooth, the guide member groove 49*g* may be omitted. In this case, the productivity of manufacturing the guide member 49 can be improved because a guide member groove 49*g* is not formed.

Likewise, a fixing member groove 50*g* is disposed to the fixing member 50. If the surface of the fixing member 50 that contacts the escape wheel 23 is smooth, the fixing member groove 50*g* may be omitted. In this case, the productivity of manufacturing the fixing member 50 can be improved because a fixing member groove 50*g* is not formed.

The foregoing embodiments can be summarized as described below.

A timepiece part according to the invention includes a rotating axle including a first shaft and a coaxially disposed second shaft that is larger in diameter than the first shaft, and a seat disposed to the connection between the first shaft and the second shaft; a guide member disposed in contact with the seat, having a first opening in which the first shaft is inserted, and a diameter greater than the second shaft; a flat member disposed in contact with the guide member, and having a second opening in which the first shaft is inserted; and a fixing member disposed in contact with the flat member, having a third opening in which the first shaft is inserted, and a diameter greater than the second shaft.

In this configuration, the timepiece part has a rotating axle, and a seat is provided at the junction between the side of the first shaft and the side of the second shaft. A second diameter, which is the diameter of the second shaft, is greater than a first diameter, which is the diameter of the first shaft. Half of the length of the second diameter minus the length of the first diameter is the width of the seat.

The guide member has a first opening. The flat member has a second opening. The fixing member has a third opening. The first shaft is inserted through the first hole in the guide member, the second hole in the flat member, and the third hole in the fixing member. The guide member, flat member, and fixing member are disposed coaxially in order from the second shaft side.

The seat of the rotating axle contacts the guide member, and the guide member contacts the flat member. The flat member contacts the fixing member, and the fixing member is fixed to the first shaft. Therefore, the flat member is held between the guide member and the fixing member.

Supporting the flat member at a position separated from the axis of the first shaft enables holding the angle of the plane direction of the flat member to the axis of the first shaft more perpendicular than when the flat member is supported at a position near the axis of the first shaft. The length of the guide member in the radial direction of the rotating axle is greater than the second diameter. Therefore, disposing the guide member between the seat and the flat member can hold the angle of the plane direction of the flat member to the axis of the first shaft closer to perpendicular than when the flat member is disposed in contact with the seat.

The length of the fixing member in the radial direction of the rotating axle is greater than the second diameter. Therefore, providing a fixing member that is longer than the second diameter can hold the angle of the plane direction of the flat member to the axis of the first shaft closer to perpendicular than when the length of the fixing member in the radial direction of the rotating axle is equal to the second diameter.

In addition, the closer the angle in the plane direction of the flat member to the axis of the first shaft is to perpendicular, the less runout of the flat member to the axial direction there is when the rotating axle turns. The timepiece part of the invention can therefore reduce axial runout of the flat member when the rotating axle turns.

The guide member of the timepiece part described above is preferably made from an iron alloy or a titanium alloy, the flat member contains silicon, and the fixing member is made from copper, a copper alloy, aluminum, or an aluminum alloy.

In this configuration the guide member is made from an iron alloy or a titanium alloy. Iron alloys and titanium alloys have high stiffness, and therefore are not easily deformed.

The flat member contains silicon, which is a brittle material. The hardness of the flat member is therefore high, and is more difficult to deform than the guide member.

The fixing member is made from copper, a copper alloy, aluminum, or an aluminum alloy. The fixing member therefore deforms more easily than the guide member and flat member.

The first shaft is inserted to the guide member, flat member, and fixing member, and the fixing member is pushed to the seat side. The seat and guide member are forced into contact with each other by this pressure.

The guide member and flat member are similarly made to contact. The flat member and fixing member are also similarly made to contact. At this time the fixing member can be fixed to the first shaft without deforming the guide member and flat member. As a result, the angle of the plane direction of the flat member to the axis of the first shaft can be made closer to perpendicular.

In the timepiece part described above the fixing member preferably has a part that is recessed in the surface that contacts the flat member and does not contact the flat member.

In this configuration a recess is formed in the surface of the fixing member that contacts the flat member. The part of the fixing member that is not recessed contacts the flat member, and the recessed part is separated from the flat member. The part that is not recessed can therefore reliably contact the flat member.

The first shaft of the timepiece part preferably has a groove formed in the axial direction of the first shaft; the flat member has a support part that overlaps the guide member and the fixing member in a plan view from the axial direction, and a rim with multiple teeth; and the support part includes multiple first ribs disposed between the rim and the rotating axle, and a second rib disposed between the multiple first ribs, the ends of the first ribs are disposed in the groove, and the end of the second rib pushes against the rotating axle.

In this configuration the first shaft has a groove, and the groove is disposed lengthwise in the axial direction of the first shaft. The flat member has a support part and a rim. The rim has multiple teeth, and the timepiece part functions as a gear. The support part holds the rotating axle. The support part has first ribs and second ribs. Multiple first ribs are disposed to the rim extending lengthwise to the rotating axle side. The ends of the first ribs are disposed in the grooves, and are held between the guide member and the fixing member. As a result, when the rotating axle turns, the first ribs transfer torque from the rotating axle to the rim, and cause the rim to turn.

Because there are multiple first ribs, there are also multiple second ribs. The second ribs are disposed between the first ribs.

The pressure parts push the rotating axle from multiple directions and support the rotating axle. Because multiple second ribs push the first shaft, the internal stress on each second rib can be reduced. The flat member is silicon and brittle. However, torque received from the rotating axle is received by multiple first ribs, and the force applying pressure to hold the rotating axle is distributed among the multiple second ribs. Therefore, destruction of the support part due to stress can be reduced.

In the timepiece part described above, the second ribs preferably branch from the first ribs, and a spring member is disposed between the ends of the second ribs and the junction with the first ribs.

In this configuration the second ribs are disposed branching from the first ribs. A spring member is disposed between the ends of the second ribs and the junction to the first ribs. Because the second ribs have a spring member, the second ribs can reliably urge the pressure part.

The timepiece part is preferably an escape wheel, pallet, barrel complete, or gear.

The configuration of the timepiece part described above can be applied to any of the escape wheel, pallet, barrel complete, and gears. By applying the configuration of a timepiece part described above to the escape wheel, pallet, barrel complete, or a gear, axial runout of the flat member can be reduced when the rotating axle turns.

A timepiece according to the invention includes the timepiece part described above.

In this configuration the timepiece uses the timepiece part described above. The timepiece part can reduce axial runout of the flat member when the rotating axle turns. A timepiece that reduces problems resulting from axial runout of the flat member can therefore be provided.

In the timepiece part described above the diameter of the first opening is preferably greater than the diameter of the first shaft, and the fixing member is tightly fit to the rotating axle.

In this configuration, the diameter of the first opening is greater than the diameter of the first shaft. Therefore, deformation of the guide member when the guide member is placed on the first shaft can be reduced. The fixing member is also tightly fit to the rotating axle. The guide member and flat member can therefore be made to contact by pushing the fixing member to the flat member. The flat member and fixing member can likewise be set in contact. As a result, the guide member and the fixing member can control the angle of the plane direction of the flat member to the axis of the rotating axle.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A timepiece part comprising:

a rotating axle including a first shaft that has multiple grooves formed in an axial direction; and a flat member including:

an opening in which the first shaft is inserted;

a rim with multiple teeth; and multiple first ribs disposed between the rim and the rotating axle and radiating from roots of the multiple teeth of the rim toward the first shaft in a radial direction in a plan view, ends of the multiple first ribs being disposed in the multiple grooves, respectively, wherein each of the multiple first ribs is substantially bar-shaped and linearly radiates from the rim toward the first shaft, a length along the radial direction of each of the multiple first ribs is longer than a width along a width direction of each of the multiple first ribs, and the width direction is perpendicular to the radial direction, each of the multiple first ribs has a first width and a second width along the width direction, the first width of a first part of each of the multiple first ribs is smaller than the second width of a second part of each of the multiple first ribs, and the first part is located directly adjacent to the first shaft, and the second part is located directly adjacent to one of the roots of the multiple teeth of the rim.

2. The timepiece part described in claim 1, wherein the opening is formed by the ends of the multiple first ribs.

3. The timepiece part described in claim 1, wherein the flat member further includes multiple second ribs disposed between the multiple first ribs, respectively; and ends of the multiple second ribs push against the first shaft.

4. The timepiece part described in claim 3, wherein in the plan view, the multiple second ribs are disposed radiating toward the first shaft.

5. The timepiece part described in claim 3, wherein the rotation axle has a second shaft disposed coaxially with the first shaft;

the second shaft has a diameter greater than that of the first shaft; and the second shaft has multiple teeth and forms a pinion.

6. The timepiece part described in claim 5, wherein
the multiple teeth of the second shaft have roots, respectively; and
the roots extend to the multiple grooves.

7. The timepiece part described in claim 6, wherein
the roots are seven roots; and
the multiple grooves are seven grooves.

8. The timepiece part described in claim 5, further comprising:
a wheel meshing with the second shaft, wherein
the flat member is an escape wheel.

9. The timepiece part described in claim 1, wherein
the flat member contains silicon, and
the rotating axle contains carbon steel, tantalum or tungsten.

10. The timepiece part described in claim 1, wherein
the ends of the multiple first ribs have a round shape in the plan view.

11. The timepiece part described in claim 1, wherein
each of the multiple grooves is formed in a round shape in the plan view.

* * * * *